US008421702B2

(12) United States Patent
Desclos et al.

(10) Patent No.: US 8,421,702 B2
(45) Date of Patent: Apr. 16, 2013

(54) MULTI-LAYER REACTIVELY LOADED ISOLATED MAGNETIC DIPOLE ANTENNA

(75) Inventors: Laurent Desclos, San Diego, CA (US); Sebastian Rowson, San Diego, CA (US); Jeffrey Shamblin, San Diego, CA (US); Young Cha, San Diego, CA (US); Chulmin Han, San Diego, CA (US); Byoeng Sug Kwak, Gunpo-si (KR)

(73) Assignee: Ethertronics, Inc., San Diego, CA (US)

( * ) Notice: Subject to any disclaimer, the term of this patent is extended or adjusted under 35 U.S.C. 154(b) by 403 days.

(21) Appl. No.: 12/758,725

(22) Filed: Apr. 12, 2010

(65) Prior Publication Data

US 2010/0259456 A1 Oct. 14, 2010

Related U.S. Application Data

(63) Continuation-in-part of application No. 11/847,207, filed on Aug. 29, 2007, now abandoned, and a continuation-in-part of application No. 12/059,346, filed on Mar. 31, 2008, now Pat. No. 7,777, 686.

(60) Provisional application No. 61/168,550, filed on Apr. 10, 2009.

(51) Int. Cl.
*H01Q 9/28* (2006.01)

(52) U.S. Cl.
USPC ..... 343/795; 343/700 MS; 343/846

(58) Field of Classification Search ..... 343/700, 343/730, 795, 846
See application file for complete search history.

(56) References Cited

U.S. PATENT DOCUMENTS

| | | | | |
|---|---|---|---|---|
| 6,539,253 | B2 * | 3/2003 | Thompson et al. | 607/2 |
| 7,363,087 | B2 * | 4/2008 | Nghiem et al. | 607/60 |
| 7,692,601 | B2 * | 4/2010 | Bisiules et al. | 343/803 |
| 2006/0020300 | A1 * | 1/2006 | Nghiem et al. | 607/60 |
| 2009/0228074 | A1 * | 9/2009 | Edgell et al. | 607/60 |

* cited by examiner

*Primary Examiner* — Tho G Phan
(74) *Attorney, Agent, or Firm* — Coastal Patent Agency; Joshua S. Schoonover

(57) ABSTRACT

A multi-layer reactively loaded isolated magnetic (IMD) dipole with improved bandwidth and efficiency characteristics to be used in wireless communications and other applicable systems. The multi-layer IMD antenna comprises a first element positioned above a ground plane, a second element positioned above a ground plane and coupled to the first portion. Reactive components are integrated into one or both elements to optimize the frequency response of the antenna. The range of frequencies covered to be determined by the shape, size, and number of elements in the physical configuration of the components. Portions of or the entire ground plane can be removed beneath the elements.

17 Claims, 9 Drawing Sheets

MULTI-LAYER REACTIVELY LOADED ISOLATED MAGNETIC DIPOLE ANTENNA

CROSS REFERENCE TO RELATED APPLICATIONS

This application is related to commonly-owned co-pending U.S. patent application Ser. No. 11/847,207, filed Aug. 20, 2007, entitled "Antenna with Active Elements"; the entire contents of which are hereby incorporated herein by reference. This application is also related to commonly-owned co-pending U.S. patent application Ser. No. 12/059,346, filed Mar. 31, 2008 and entitled "Multilayer Isolated Magnetic Dipole Antenna"; the entire contents of which are hereby incorporated by reference. Additionally, this application relates to U.S. Provisional Application Ser. No. 61/168,550 filed Apr. 10, 2009, the entire contents of which are hereby incorporated by reference.

FIELD OF THE INVENTION

The present invention relates generally to the field of wireless communication. In particular, the present invention relates to antennas and methods of improving frequency response and selection for use in wireless communications.

BACKGROUND OF THE INVENTION

As handsets and other wireless communication devices become smaller and embedded with more applications, new antenna designs are required to address inherent limitations of these devices. With classical antenna structures, a certain physical volume is required to produce a resonant antenna structure at a particular radio frequency and with a particular bandwidth. In multi-band applications, more than one such resonant antenna structure may be required. With the advent of a new generation of wireless devices, such classical antenna structure will need to cover wider bandwidths and maintain or increase efficiency across the entire frequency range.

IMD (Isolated Magnetic Dipole) technology has been developed over the past several years to provide superior efficiency, isolation, and selectivity characteristics from embedded antennas in small wireless devices. An IMD antenna is designed to excite a magnetic dipole mode from a metal structure in such a fashion as to minimize the fringing fields typically generated between an antenna element and an adjacent ground plane. A current is induced on the antenna structure and a strong electric field is generated on the structure in the plane of the IMD element instead of a strong fringing field to the ground plane. By minimizing the coupled fields to the ground plane, with the circuit board of a wireless device taking the place of the ground plane, improved efficiency and isolation can be obtained. Single and multi-resonant elements can be created to address a wide range of frequency bands.

This patent application involves the use of a second conductive element coupled to an antenna element to improve frequency bandwidth. Lumped components such as capacitors and inductors can be attached to either conductive element and used to increase the bandwidth or shift the frequency of operation. Active components can be used to dynamically tune the antenna. The present invention addresses the need to create more efficient antennas with a higher bandwidth adaptable to fit within present device designs.

SUMMARY OF THE INVENTION

In one embodiment of the invention, a multi-layer, reactively loaded IMD antenna pertains to improved methods of exciting a structure and setting up the IMD mode. The concept involves placing a conductor in close proximity to the slot or conductive regions of an IMD antenna to create a reactive section capable of increasing the bandwidth of the IMD antenna. The conductor can be capacitively coupled to the IMD antenna or can be connected to a portion of the IMD antenna. Lumped reactance in the form of capacitors and/or inductors can be incorporated into the antenna structure, to both the driven element and/or the coupled element, to provide additional adjustment to the frequency response. Increases in both efficiency and bandwidth have been documented from this technique which more efficiently utilizes the volume that the antenna occupies.

Another embodiment of the invention implemented is similar to the first technique except that the capacitive element coupled across a portion of the IMD antenna is directly grounded to the ground plane or is connected to ground using lumped or distributed reactance.

Another embodiment of the invention that can be implemented involves replacing the reactive component coupled to an IMD antenna with an active component. The active component can be any one or more of voltage controlled tunable capacitors, voltage controlled tunable phase shifters, FET's, switches, MEMs device, transistor, or circuit capable of exhibiting ON-OFF and/or actively controllable conductive/inductive characteristics. The active component will provide the ability to change the frequency response of the antenna in real time, allowing for a continuous optimization of the antenna as the required frequency of operation changes.

The active component will provide the ability to change the frequency response of the antenna in real time, allowing for a continuous optimization of the antenna as the required frequency of operation changes.

Figure 1:
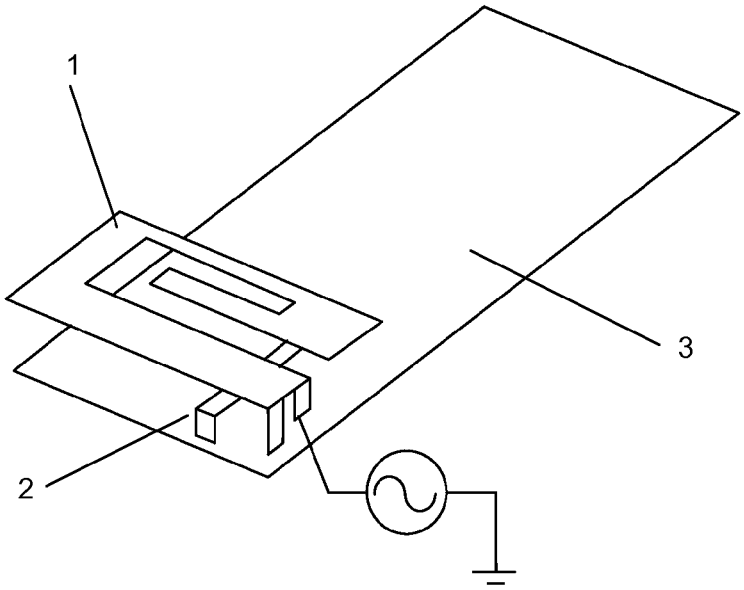
FIG. 1 illustrates an exemplary isolated magnetic dipole (IMD) antenna comprised of an IMD element with a second element positioned beneath it.

While particular embodiments of the present invention have been disclosed, it is to be understood that various different modifications and combinations are possible and are contemplated within the true spirit and scope of the appended claims. There is no intention, therefore, of limitations to the exact abstract and disclosure herein presented.

DETAILED DESCRIPTION OF THE PREFERRED EMBODIMENTS

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions.

In a general embodiment of the invention, an antenna comprises one or more antenna elements having a feed and ground connection and positioned over a ground plane. One or more of the antenna elements can further comprise a first portion, a second portion and a gap or disconnection therebetween. A bridge component can connect the first portion and second portion at the gap. The bridge component can be any one of: a capacitor, inductor, resistor, diode, active component, or a switch. The bridge component can be used to optimize the frequency response of the antenna.

The antenna element can be limited to one gap between a first portion and a second portion. Alternatively, the antenna element can have multiple gaps between a plurality of portions. In the above example, an antenna element has two portions (a first portion and a second portion) and one gap therebetween. In another example an antenna element can have three portions and two gaps therebetween. In yet another example an antenna element can have four portions and three gaps therebetween. Generically, any number of portions can be represented by "N" portions. Likewise, any number of associated gaps between N portions can be represented by (N-1), such that an antenna element will comprise N portions and (N-1) gaps therebetween, wherein N is a positive integer greater than 1; i.e. 2, 3, 4, 5, 6, . . . , etc.

In a similar embodiment, a plurality of antenna elements each individually comprise N portions and (N-1) gaps therebetween, wherein one or more bridge components connect a first portion and a second portion at each of the gaps.

Antenna elements can be one of: a monopole, dipole, IFA (inverted F antenna), and PIFA (planar inverted F antenna). Alternatively, any antenna element known in the art can be adequately used in to achieve substantially the same results in substantially the same way as disclosed herein.

Feed and ground connections can be connected using a bridge component to further optimize the frequency response of the antenna.

Combinations of the above examples will lead one having ordinary skill in the art to understand many variations which may not be fully described here in detail, however will be readily understood by the specification and figures herein and enabled without undue experimentation.

FIG. 1 illustrates an exemplary isolated magnetic dipole (IMD) antenna comprised of an IMD element 1 with a second element 2 positioned beneath it. Both elements are positioned above a ground plane 3.

Figure 2:
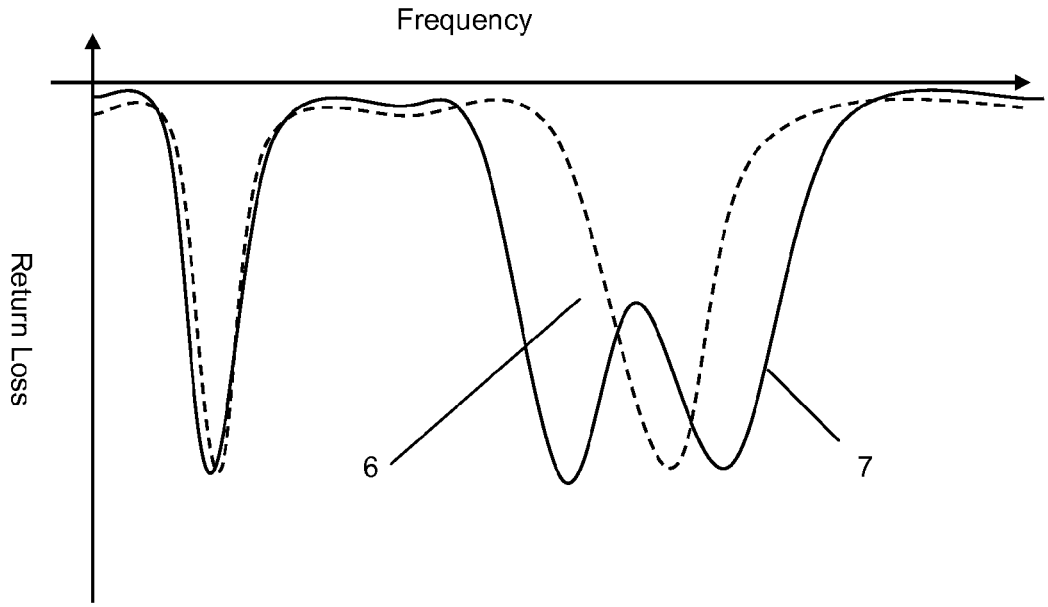
FIG. 2 illustrates an exemplary frequency characteristic associated with the antenna of FIG. 1. The solid line is the frequency response of the IMD element with second element. The dashed line is the frequency response of the IMD element only.

FIG. 2 illustrates an exemplary frequency characteristic associated with the antenna of FIG. 1. The dashed line 6 is the frequency response of the IMD element only. The solid line 7 is the frequency response of the IMD element with second element. The addition of the second element results in the second resonance in the high band frequency response, which results in increased bandwidth.

Figure 3:
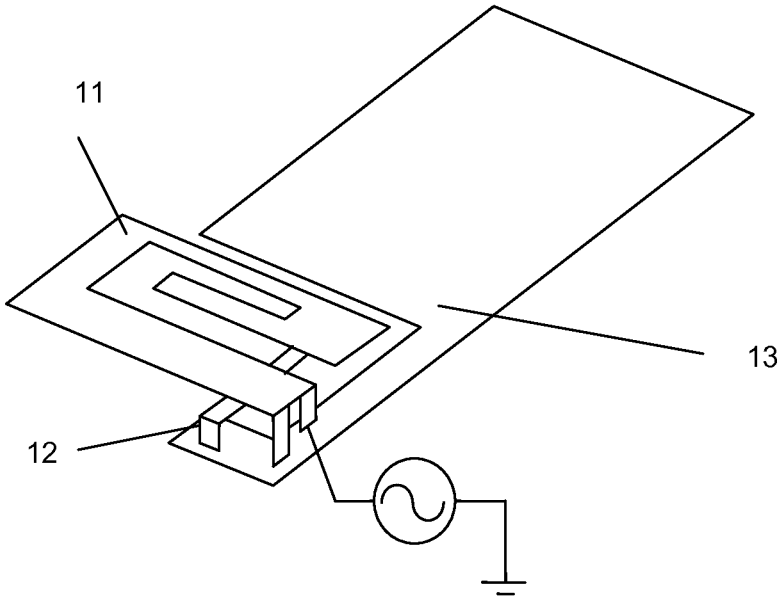
FIG. 3 illustrates the antenna of FIG. 1 with a portion of the ground plane removed from beneath the antenna.

FIG. 3 illustrates an exemplary isolated magnetic dipole (IMD) antenna comprised of an IMD element 6 with a second element 7 positioned beneath it. Both elements are positioned above a ground plane 8, where a portion of the ground plane beneath the elements has been removed.

Figure 4:
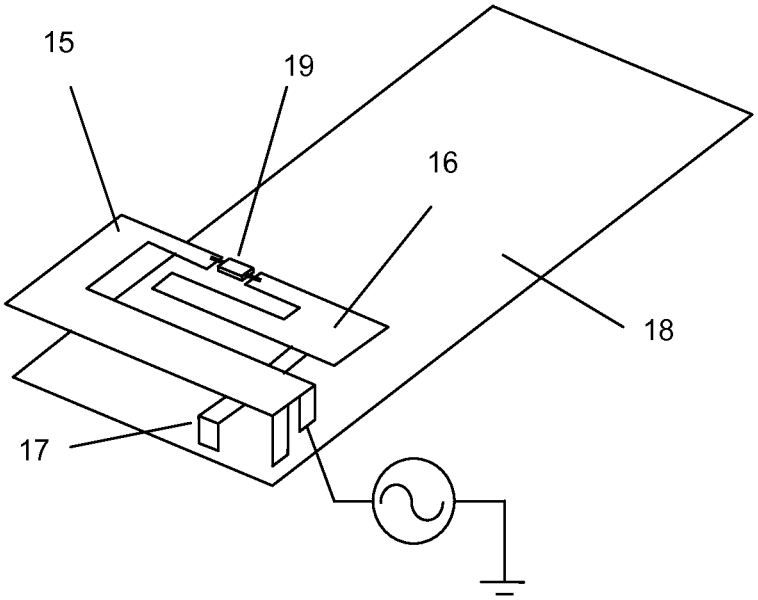
FIG. 4 illustrates an IMD antenna where a portion of the IMD element is disconnected from the rest of the element, and a component is used to attach the two parts. The component or components used to connect the two portions can include capacitors, inductors, resistors, diodes, active components, or switches. These components provide a method of optimizing the frequency response of the antenna.

FIG. 4 illustrates an IMD antenna where a portion of the IMD element 16 is disconnected from the rest of the element 15, and a component 19 is used to attach the two parts. The component or components used to connect the two portions can include capacitors, inductors, resistors, diodes, active components, or switches. These components provide a method of optimizing the frequency response of the antenna. A second element 17 is positioned beneath the first element, with the entire antenna positioned above a ground plane 18.

Figure 5:
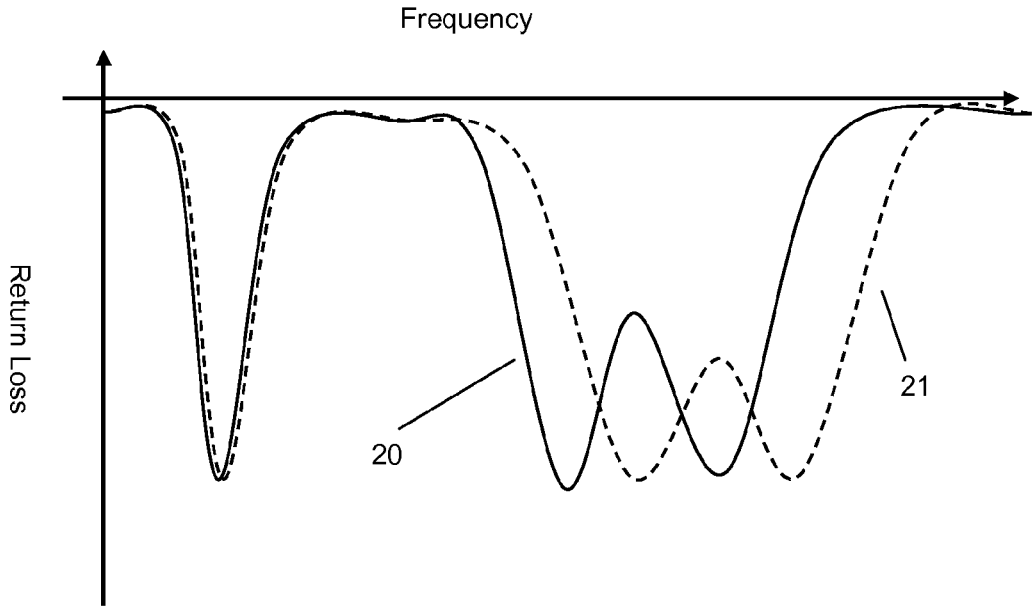
FIG. 5 illustrates an exemplary frequency characteristic associated with the antenna of FIG. 4. The solid line is the frequency response of the IMD antenna prior to attaching the reactive component. The dashed line is the frequency response of the IMD antenna after disconnecting a portion of the element and re-attaching using a reactive component.

FIG. 5 illustrates an exemplary frequency characteristic associated with the antenna of FIG. 4. The solid line 20 is the frequency response of the IMD antenna prior to attaching the reactive component. The dashed line 21 is the frequency response of the IMD antenna after disconnecting a portion of the element and re-attaching using a reactive component. Proper component type and value selection can be made to affect the desired frequency response from the antenna.

Figure 6:
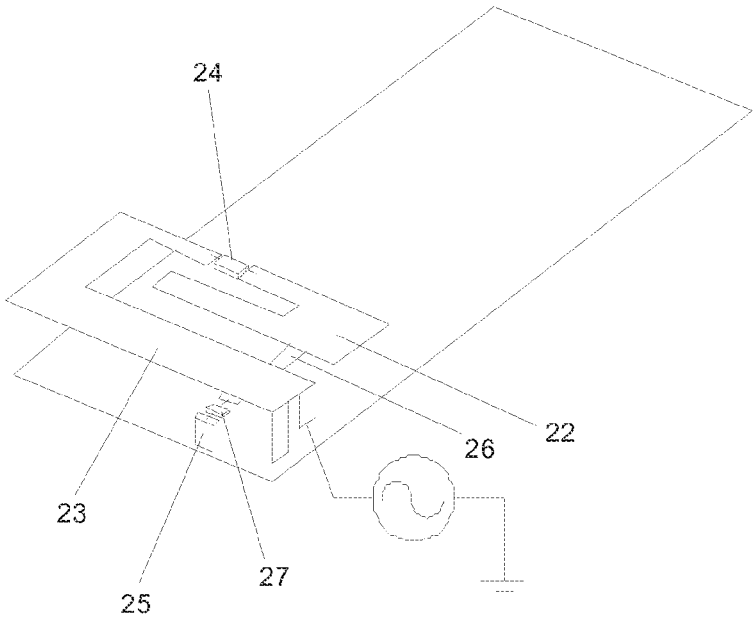
FIG. 6 illustrates an IMD antenna where a portion of the IMD element is disconnected from the rest of the element, and a component is used to attach the two parts. A portion of the second element is disconnected from the rest of the element, and a component is used to attach the two parts. The component or components used to connect the two portions can include capacitors, inductors, resistors, diodes, active components, or switches. These components provide a method of optimizing the frequency response of the antenna.

FIG. 6 illustrates an IMD antenna where a portion of the IMD element 22 is disconnected from the rest of the element 23, and a component 24 is used to attach the two parts. A portion of the second element 25 is disconnected from the rest of the element 26, and a component 27 is used to attach the two parts. The component or components used to connect the two portions can include capacitors, inductors, resistors, diodes, active components, or switches. These components provide a method of optimizing the frequency response of the antenna.

Figure 7:
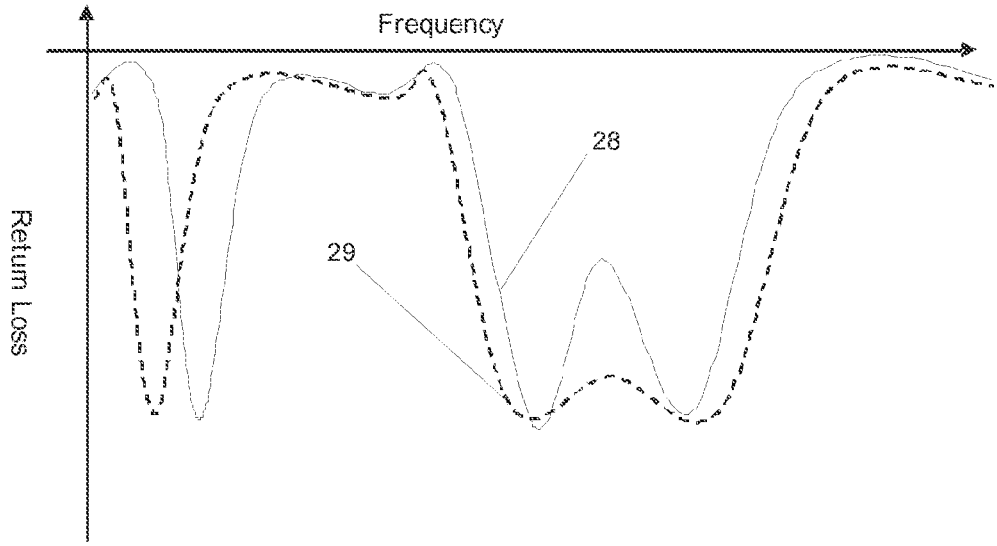
FIG. 7 illustrates an exemplary frequency characteristic associated with the antenna of FIG. 6. The solid line is the frequency response of the IMD antenna prior to attaching the reactive components to the IMD element and the second element. The dashed line is the frequency response of the IMD antenna after disconnecting a portion of each element and re-attaching using a reactive component. Proper selection of the components allow for the shifting of the low frequency resonance and the increase in bandwidth of the high frequency resonance.

FIG. 7 illustrates an exemplary frequency characteristic associated with the antenna of FIG. 6. The solid line 28 is the frequency response of the IMD antenna prior to attaching the reactive components to the IMD element and the second element. The dashed line 29 is the frequency response of the IMD antenna after disconnecting a portion of each element and re-attaching using a reactive component. Proper selection of the components allow for the shifting of the low frequency resonance and the increase in bandwidth of the high frequency resonance.

Figure 8:
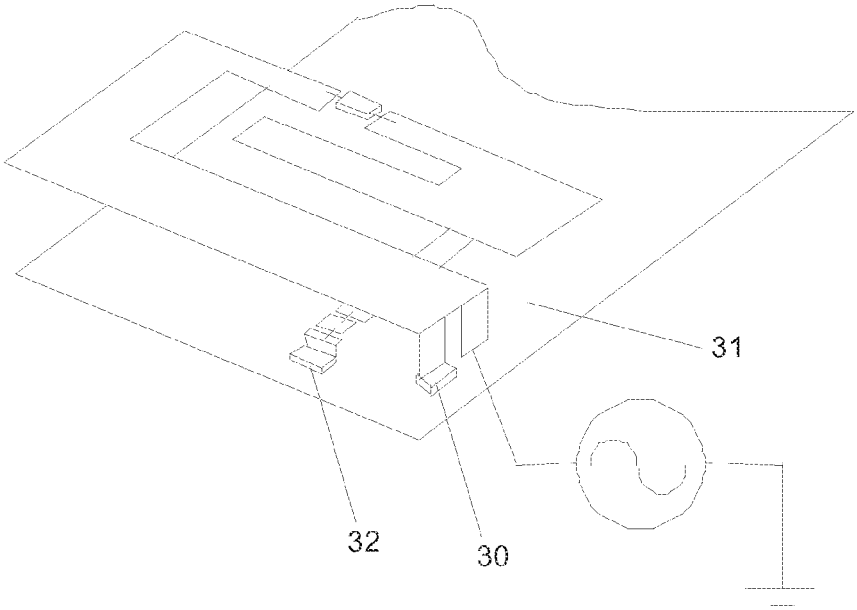
FIG. 8 illustrates an IMD antenna where a portion of both the IMD element and the second element is disconnected and components are installed to re-connect the parts. Additionally, components are positioned between the ground leg of the IMD element and the ground plane, as well as the second element and the ground plane. These additional components provide additional tuning mechanisms for the antenna.

FIG. 8 illustrates an IMD antenna where a portion of both the IMD element and the second element is disconnected and components are installed to re-connect the parts. Additionally, components are positioned between the ground leg 30 of the IMD element and the ground plane 31, as well as the second element 32 and the ground plane 31. By coupling additional components at the ground junction, additional optimization of antenna performance over a wider frequency range can occur.

Figure 9:
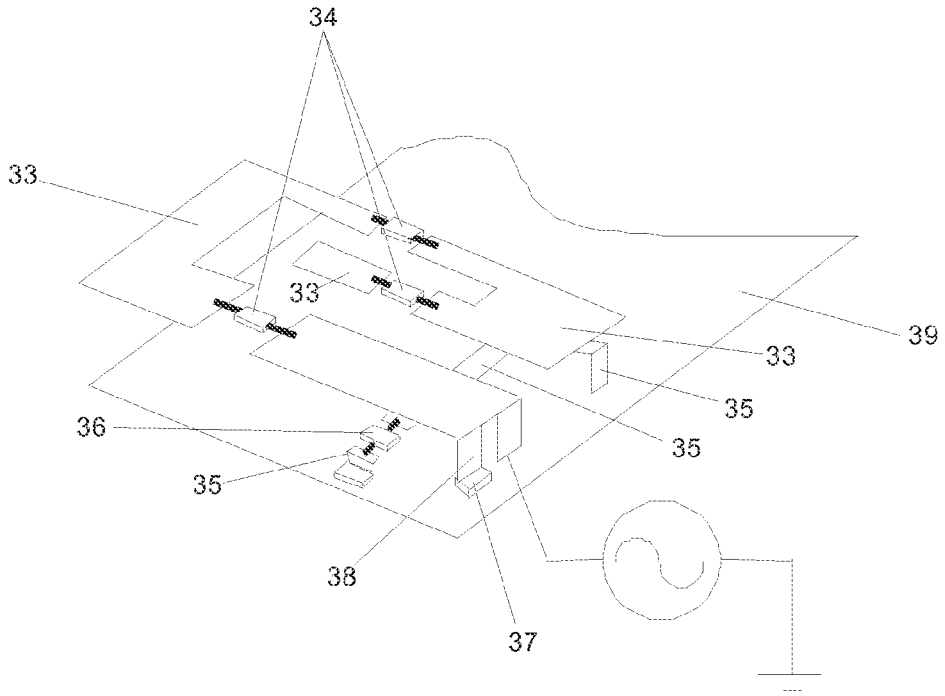
FIG. 9 illustrates an IMD antenna where the IMD element is disconnected at several locations, with the individual parts re-connected by using components. The second element is disconnected and components are installed to re-connect the parts. Additionally, components are positioned between the ground leg of the IMD element and the ground plane, as well as the second element and the ground plane. These additional components provide additional tuning mechanisms for the antenna.

FIG. 9 illustrates an IMD antenna where the IMD element 33 is disconnected at several locations, with the individual parts re-connected by using components 34. The second element 35 is disconnected and components 36 are installed to re-connect the parts. Additionally, components 37 are positioned between the ground leg 38 of the IMD element and the ground plane 39, as well as the second element 35 and the ground plane 39. These additional components provide additional tuning mechanisms for the antenna.

Figure 10:
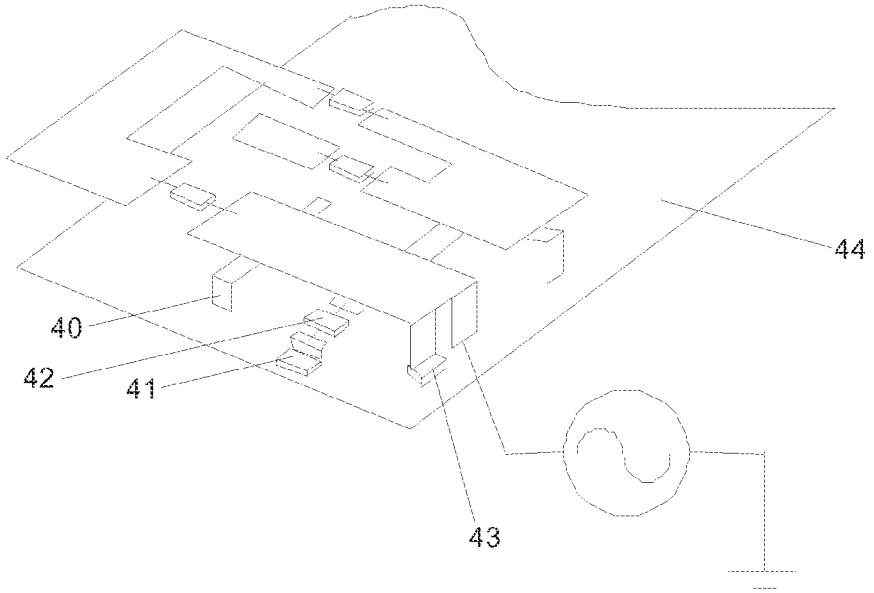
FIG. 10 illustrates an IMD antenna where the IMD element is disconnected at several locations, with the individual parts re-connected by using components. Multiple elements are positioned in close proximity to the IMD element, One or several of the elements are disconnected and components are installed to re-connect the parts. Additionally, components are positioned between the ground leg of the IMD element and the ground plane, as well as one or several of the other elements. These additional components provide additional tuning mechanisms for the antenna.

FIG. 10 illustrates an IMD antenna where the IMD element is disconnected at several locations, with the individual parts re-connected by using components as shown in FIG. 9. Multiple elements 40, 41, and 45 are positioned in close proximity to the IMD element. One or several of the elements are disconnected and components 42 are installed to re-connect the parts. Additionally, components 43 are positioned between the ground leg of the IMD element and the ground plane, as well as one or several of the other elements. These additional components provide additional tuning mechanisms for the antenna.

Figure 11:
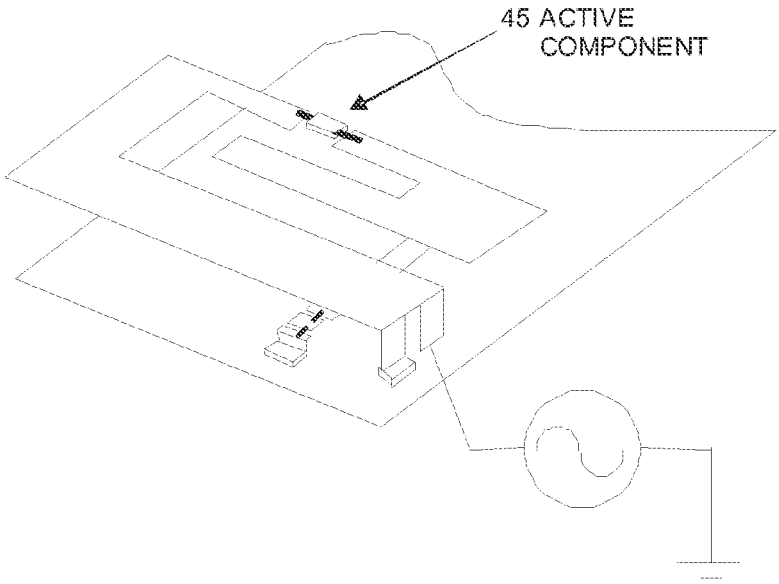
FIG. 11 illustrates an IMD antenna where one of the components is an active component. The active component will provide the ability to tune the antenna during operation. The active tuning component can be any one or more of voltage controlled tunable capacitors, voltage controlled tunable phase shifters, FET's, switches, MEMs device, transistor, or circuit capable of exhibiting ON-OFF and/or actively controllable conductive/inductive characteristics.

FIG. 11 illustrates an IMD antenna where one of the components is an active component 45. The active component will provide the ability to tune the antenna during operation. The active tuning component can be any one or more of voltage controlled tunable capacitors, voltage controlled tunable phase shifters, FET's, switches, MEMs device, transistor, or circuit capable of exhibiting ON-OFF and/or actively controllable conductive/inductive characteristics.

Figure 12:
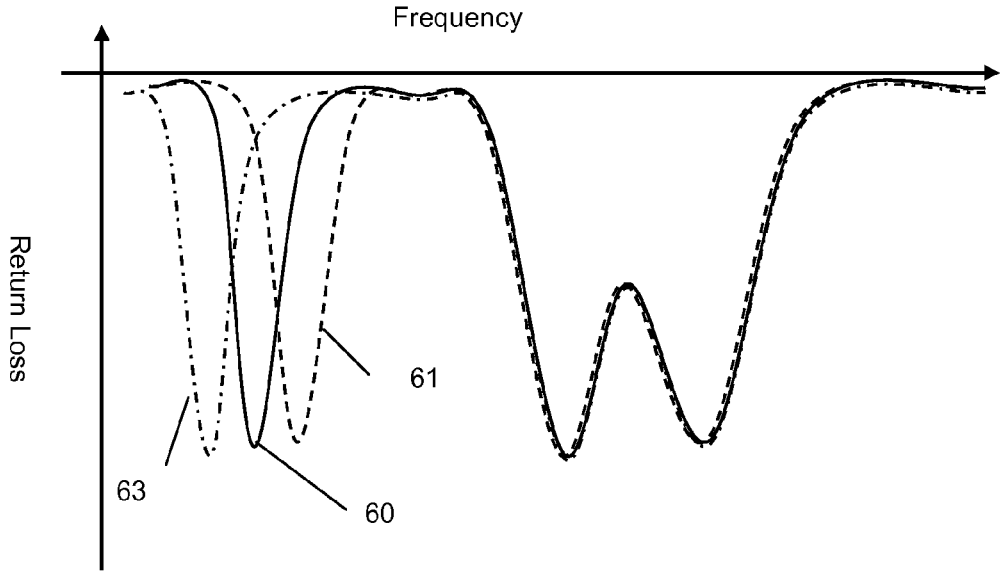
FIG. 12 illustrates an exemplary frequency characteristic associated with the antenna in FIG. 11. The low band frequency response can be varied by tuning the active component.

FIG. 12 illustrates an exemplary frequency characteristic associated with the antenna in FIG. 11. The traces labeled 60, 61, and 62 show the frequency response varying over the lower resonance as the characteristics of the active component on the antenna is varied. The low band frequency response can be varied by tuning the active component.

Figure 13:
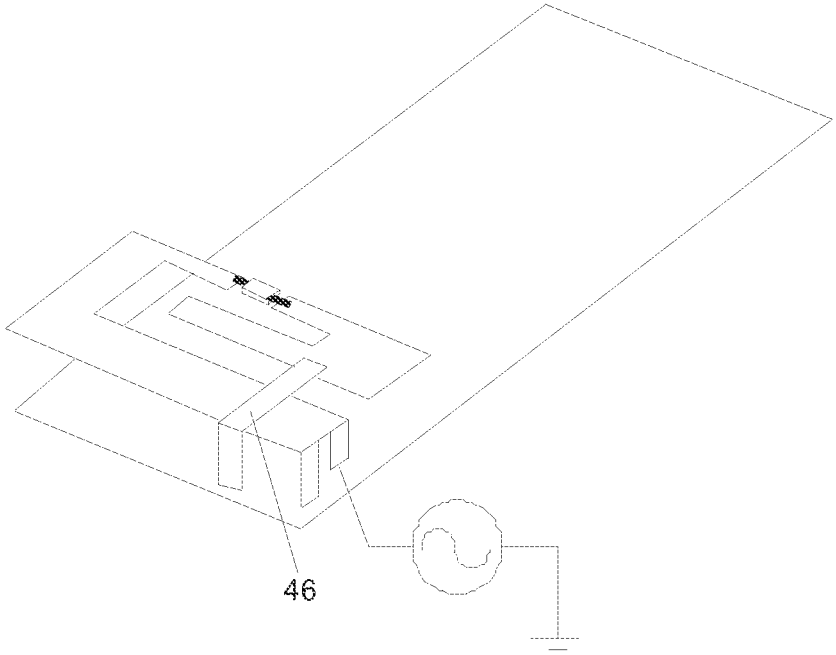
FIG. 13 illustrates an IMD antenna where the second element is positioned above the IMD element.

FIG. 13 illustrates an IMD antenna where the second element 46 is positioned above the IMD element.

Figure 14:
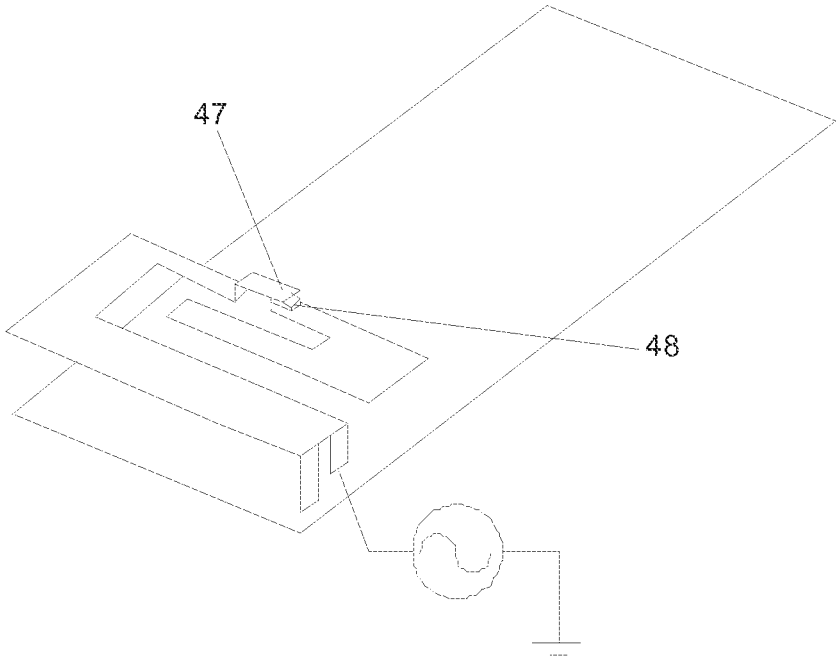
FIG. 14 illustrates an IMD antenna where a conductive element is attached to one portion of the IMD element and a component is used to attach the other end of the conductive element to another portion of the IMD element. The overlap section forms a capacitively coupled region that can be used to increase the bandwidth of the antenna as well as adjust the frequency response.

FIG. 14 illustrates an IMD antenna where a conductive element 47 is attached to one portion of the IMD element and a component 48 is used to attach the other end of the conductive element to another portion of the IMD element. The overlap section forms a capacitively coupled region that can be used to increase the bandwidth of the antenna as well as adjust the frequency response.

Figure 15A:
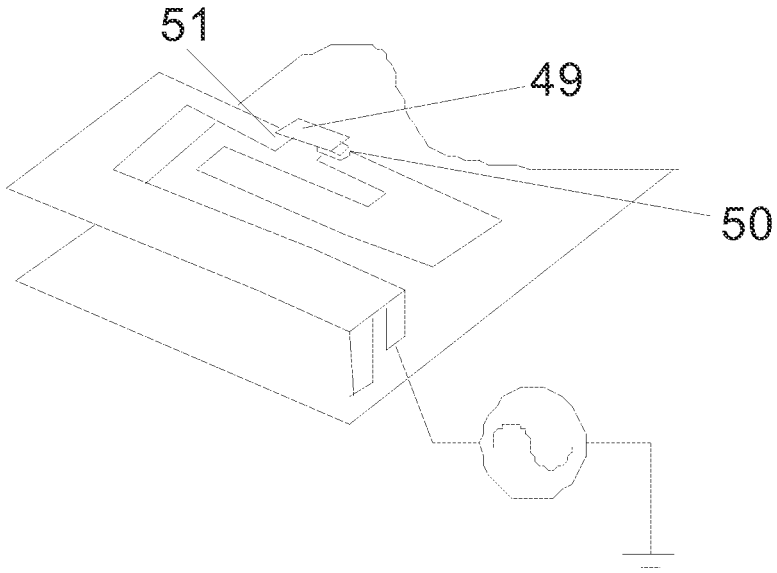
FIG. 15*a* illustrates an IMD antenna where a conductive element is attached to one portion of the IMD element using a component. The overlap section forms a capacitively-coupled region that can be used to increase the bandwidth of the antenna as well as adjust the frequency response. The component can be used to alter the frequency response of the antenna.

FIG. 15*a* illustrates an IMD antenna where a conductive element 49 is attached to one portion of the IMD element using a component 50. The overlap section forms a capacitively-coupled region 51 that can be used to increase the bandwidth of the antenna as well as adjust the frequency response. The component can be used to alter the frequency response of the antenna.

Figure 15B:
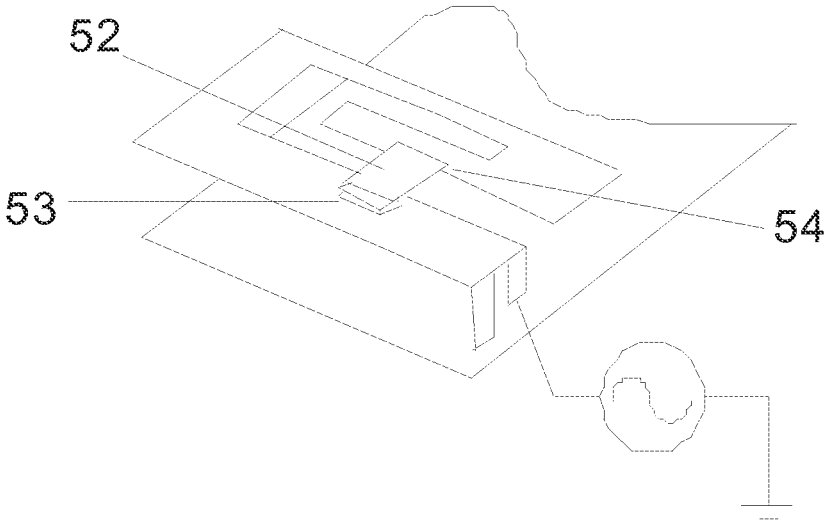
FIG. 15*b* illustrates an IMD antenna where a conductive element is positioned to couple across the main slot. A component is used to attach the conductive element to a portion of the IMD element. The overlap section forms a capacitively-coupled region that can be used to increase the bandwidth of the antenna as well as adjust the frequency response. The component can be used to alter the frequency response of the antenna.

FIG. 15*b* illustrates an IMD antenna where a conductive element 52 is positioned to couple across the main slot. A component 53 is used to attach the conductive element to a portion of the IMD element. The overlap section forms a capacitively-coupled region 54 that can be used to increase the bandwidth of the antenna as well as adjust the frequency response. The component can be used to alter the frequency response of the antenna.

Figure 16:
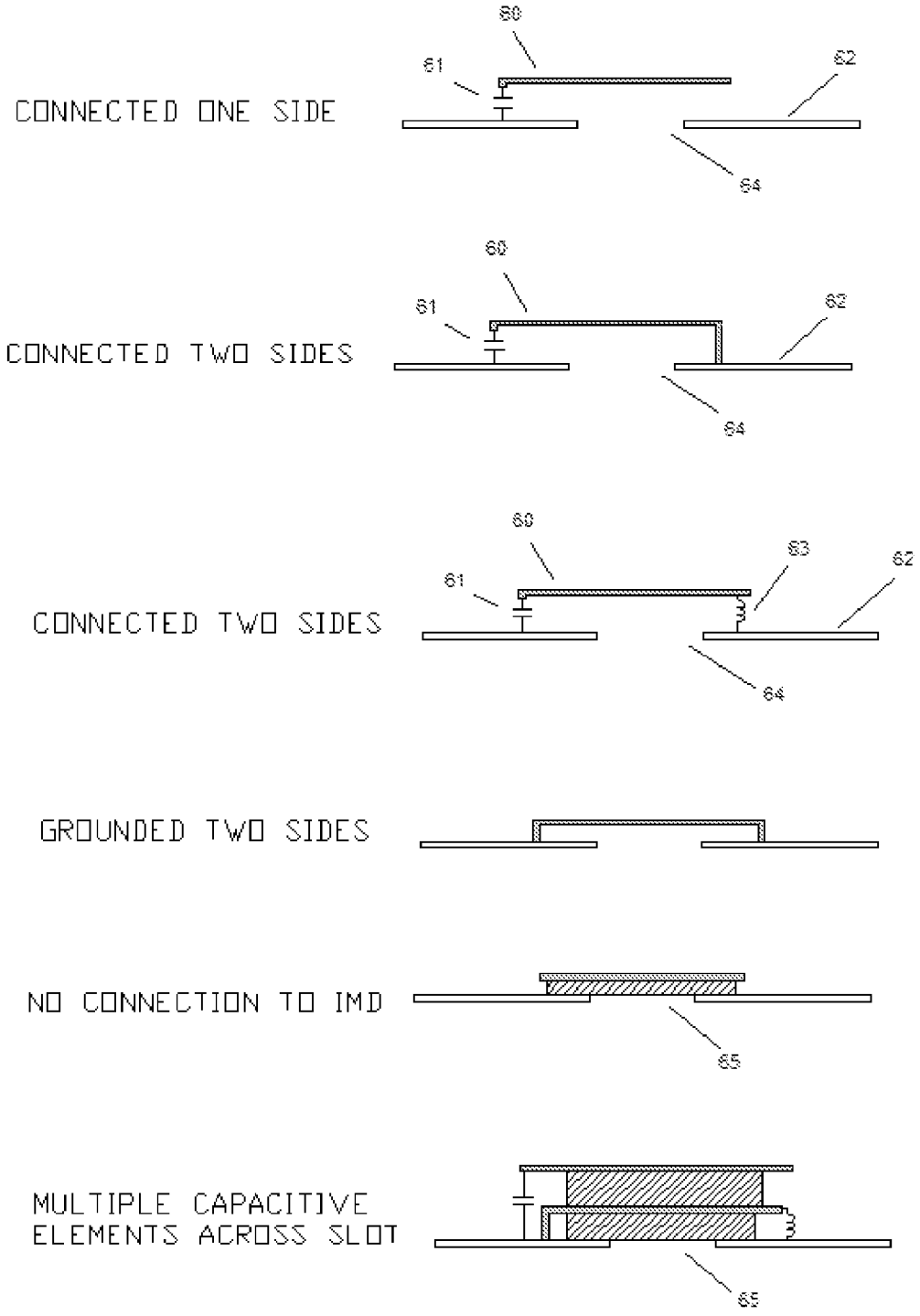
FIG. 16 illustrates methods of connecting one or a plurality of conductive elements across the slot region of an IMD antenna, or across a discontinuity formed when portions of an IMD antenna are disconnected.

FIG. 16 illustrates methods of connecting one or a plurality of conductive elements across the slot region of an IMD antenna, or across a discontinuity formed when portions of an IMD antenna are disconnected.

While particular embodiments of the present invention have been disclosed, it is to be understood that various different modifications and combinations are possible and are contemplated within the true spirit and scope of the appended claims. There is no intention, therefore, of limitations to the exact abstract and disclosure herein presented.

What is claimed is:

1. An antenna, comprising;

an IMD (isolated magnetic dipole) element positioned above a ground plane, a second element positioned above said ground plane in proximity with said IMD element, said IMD element comprising a feed and ground connection and being connected to one of a transceiver or a receiver, said IMD element having a first portion, a second portion and a gap therebetween, wherein a bridge component connects said first portion to said second portion, said second element having a first end and a second end, wherein said second element is connected to said ground plane at said first end, and wherein said second element is capacitively coupled to said IMD element at said second end.

2. The antenna of claim 1, wherein a space between said IMD element and said second element is occupied by air.

3. The antenna of claim 1, wherein a space between said IMD element and said second element is occupied by a dielectric.

4. The antenna of claim 1, wherein the ground plane is at least partially removed from an area beneath the IMD antenna.

5. The antenna of claim 1, where said second element is an IMD element.

6. The antenna of claim 1, wherein said second element is selected from the group consisting of: a monopole, dipole, IFA (inverted F antenna), and PIFA (planar inverted F antenna).

7. The antenna of claim 1, wherein said bridge component is selected from the group consisting of: a capacitor, inductor, resistor, diode, active component, or a switch.

8. The antenna of claim 7, wherein said bridge component is capable of optimizing the frequency response of the antenna.

9. The antenna of claim 1, said IMD element having N portions and (N-1) gaps therebetween; wherein N is a positive integer greater than 1, and wherein one or more bridge components connect said portions at said gaps.

10. The antenna of claim 9, wherein said bridge components are individually selected from the group consisting of: a capacitor, inductor, resistor, diode, active component, or a switch.

11. The antenna of claim 10, wherein at least one of said bridge components is adapted to optimize the frequency response of the antenna.

12. The antenna of claim 1, said second element having N portions and (N-1) gaps therebetween; wherein N is a positive integer greater than 1, and wherein one or more bridge components connect said portions at said gaps.

13. The antenna of claim 12, said IMD element having N portions and (N-1) gaps therebetween; wherein N is a positive integer greater than 1, and wherein one or more bridge components connect said portions at said gaps.

14. The antenna of claim 1, wherein a bridge component connects said second element to said ground plane.

15. The antenna of claim 1, wherein a bridge component connects said IMD element to said ground plane.

16. The antenna of claim 1, said antenna comprising three or more antenna elements, said antenna elements selected from the group consisting of: a monopole, dipole, IFA (inverted F antenna), and PIFA (planar inverted F antenna), wherein a plurality of antenna elements are positioned in proximity to and coupled with said IMD element.

17. The antenna of claim 16, wherein at least one of said antenna elements comprises a first portion, a second portion and a gap therebetween, wherein a bridge component connects said first portion to said second portion at said gap.

* * * * *